United States Patent [19]

Poole

[11] 4,086,019

[45] Apr. 25, 1978

[54] TRANSMISSION MEANS FOR CENTRIFUGAL COMPRESSORS

[75] Inventor: Eric John Poole, Wendover, England

[73] Assignee: Compair Industrial Limited, England

[21] Appl. No.: 688,561

[22] Filed: May 21, 1976

Related U.S. Application Data

[63] Continuation-in-part of Ser. No. 543,182, Jan. 22, 1975, abandoned.

[30] Foreign Application Priority Data

Jan. 31, 1974 United Kingdom ..... 4604/74

[51] Int. Cl.[2] ..... F01B 25/02; F01D 17/08; F01D 15/12; F16H 37/06

[52] U.S. Cl. ..... 415/18; 415/27; 415/49; 415/122 R; 415/123; 74/675; 417/223; 417/253

[58] Field of Search ..... 415/122 R, 123, 18, 415/21, 26, 49, 27, 30; 74/785, 786, 789, 790, 675; 417/374, , 247, 223, 253

[56] References Cited

U.S. PATENT DOCUMENTS

| | | | |
|---|---|---|---|
| 1,936,566 | 11/1933 | Davenport | 415/122 X |
| 2,228,239 | 1/1931 | Ammann | 415/122 X |
| 2,301,072 | 11/1942 | Nardone | 415/18 X |
| 2,403,381 | 7/1946 | Lawrence | 415/122 X |
| 2,403,579 | 7/1946 | Carpenter | 415/122 UX |
| 2,441,779 | 5/1948 | Troeger et al. | 415/27 |
| 2,485,126 | 10/1949 | Wood | 415/122 X |
| 2,961,147 | 11/1960 | Osterkamp | 415/26 X |
| 3,001,692 | 9/1961 | Schierl | 415/122 UX |
| 3,280,948 | 10/1966 | Carriere | 415/123 X |

FOREIGN PATENT DOCUMENTS

| | | | |
|---|---|---|---|
| 742,108 | 12/1932 | France | 74/785 |
| 519,169 | 3/1955 | Italy | 415/122 |
| 145,759 | 5/1931 | Switzerland | 415/122 |

*Primary Examiner*—Carlton R. Croyle
*Assistant Examiner*—Donald S. Holland
*Attorney, Agent, or Firm*—Mawhinney & Mawhinney & Connors

[57] ABSTRACT

A centrifugal compressor has at least one stage with its own impeller shaft, an inlet and an outlet for gas, and an epicyclic gear train for driving the impeller shaft. The epicyclic gear train comprises three members, a sun gear, a ring gear and a carrier on which a series of planet gears are mounted in mesh with the sun and ring gears. Means is provided for connecting a power input to one of the members of the epicyclic gear train, and means is provided connecting a second of the members to the impeller shaft. Means are provided for controlling the rotational speed of the third of the members to vary the speed of the impeller shaft of the compressor, and actuating means are provided for actuating the control means in response to the pressure of the compressed gas at the outlet.

9 Claims, 5 Drawing Figures

TRANSMISSION MEANS FOR CENTRIFUGAL COMPRESSORS

RELATED APPLICATIONS

This is a continuation-in-part of my earlier U.S. application Ser. No. 543182, filed Jan. 22, 1975, now abandoned, which claimed priority from British Patent application No. 4064/74, filed Jan. 31, 1974. An application related to the present application is U.S. application Ser. No. 542,814, filed Jan. 21, 1975, now U.S. Pat. No. 4,047,848.

BACKGROUND OF THE INVENTION

1. Field of the Invention

The invention relates to centrifugal compressors.

2. Description of the Prior Art

A well-known arrangement of integrally geared multi-stage centrifugal compressors is the "bull gear" arrangement in which the impeller shafts are parallel to one another and have respective gears mounted thereon which mesh with a central driving gear at spaced locations around the periphery of the driving gear. In such arrangements the gearing between the central driving gear and the individual impeller shafts is selected to step up the output speed of standard 2-pole 60 Hz motors which rotate at 3,600 revolutions per minute so that the impeller shaft of the final stage rotates at a speed of up to 60,000 revolutions per minute. This speed represents a gear ratio of approximately 17:1 which is as high as can be practicably obtained at present with this type of gearing. When such an arrangement of gearing is used with a standard British 2-pole 50 Hz motor which rotates at 3,000 revolutions per minute the maximum final compressor stage impeller shaft speed is limited by present day gearing to 50,000 revolutions per minute.

As the impeller speed increases so does the pressure ratio increase at which a centrifugal compressor stage of a particular flow capacity operates efficiently. Thus it may be necessary to employ more stages of compression in areas of 50 Hz electrical supply than in areas of 60 Hz electrical supply for comparable sizes of compressor operating at the same discharge pressure and using the "bull gear" arrangement. Alternatively, it will be appreciated that this feature can restrict the range of compressor sizes that may be utilised in areas of 50 Hz electrical supply compared with areas of 60 Hz electrical supply.

It also follows that an arrangement of gearing which allows higher overall gear ratios can reduce the number of stages required for normally used discharge pressures in areas of both 50 Hz and 60 Hz electrical supply.

Any standard design of integrally geared centrifugal compressor will require different arrangements of "bull gearing" according to the frequency of the electrical supply in the area where it is used which determines the drive motor running speed.

Furthermore, "bull gear" arrangements also require a large diameter driving gear in the order of 27–30 inches diameter which results in a pitch line velocity of the gear teeth higher than 25,000 feet per minute and sometimes in excess of 30,000 feet per minute at which speeds the gears need to be very accurately machined with gear tooth profiles specifically adapted to suit each individual combination of gear load and speed. A further disadvantage of this arrangement has been the design and provision of suitable bearings for the high speed compressor shafts. Rolling element bearings are generally beyond their range of suitable application and the use of plain journal bearings has generally resulted in vibration problems through oil film instability when the impeller shafts are running unloaded at normal operational speeds. This has led to the use of relatively complicated and expensive tilting pad or special profile journal bearings.

SUMMARY OF THE INVENTION

The invention provides a centrifugal compressor comprising at least one stage with its own impeller shaft; an inlet for gas to be compressed; an outlet for compressed gas; an epicyclic gear train for driving the impeller shaft which epicyclic gear train comprises three members, a sun gear, a ring gear and a carrier on which a series of planet gears are mounted in mesh with the sun and ring gears, means to connect power input means to one of the members of the epicyclic gear train and means connecting a second of the members to the impeller shaft; control means for controlling the rotational speed of the third of said members to vary the speed of the impeller shaft; and actuating means for actuating the control means in response to the pressure of the compressed gas at the outlet.

The advantage of this arrangement is that by changing the speed of said third member the speed of the output of the epicyclic train can be reduced so that the impeller shaft or shafts run at a relatively low idling speed when unloaded.

In some constructions according to the invention, said means for controlling the rotational speed of the third of the members may comprise variable speed drive means releasably connected to drive that member.

In other constructions according to the invention, said means for controlling the rotational speed of the third of the members may comprise releasable means for connecting that member to a fixed member or structure.

There may be provided a layshaft which rotates with said third of the members and extends outside a casing containing the epicyclic gear train, said means for controlling the speed of said third member being located outside the casing and operable to control the speed of the layshaft.

In some constructions according to the invention in which a layshaft is provided, said controlling means may comprise a geared member fixed to rotate with the layshaft, a worm member in mesh with that geared member and variable speed drive means for rotating the worm member, the arrangement being such that by altering the speed of the drive means the speed of said third member can be controlled by vary the speed of the impeller shaft or shafts in use.

In such constructions there may be provided clutch means operable to connect or disconnect the worm wheel from driving engagement with the geared member.

In other constructions according to the invention in which a layshaft is provided, said controlling means may comprise a disc fixed to rotate with the layshaft and brake means operable to act on the disc to brake the layshaft.

In such constructions said brake means may be operable by hydraulic pressure, said brake means being automatically released to unload impeller shaft or shafts when the hydraulic pressure is removed.

In any of the above constructions according to the invention, said input may be associated with the planet carrier and the output is associated with the sun gear.

In such constructions and where a layshaft is provided, said input may comprise an input drive shaft connected to the planet carrier, the layshaft being provided by an elongate tubular projection associated with the ring gear and surrounding a portion of said input drive shaft.

In any of the above constructions according to the invention, the epicyclic gear train may drive the impeller shaft or shafts through a further step-up gear train of parallel shaft gears.

DESCRIPTION OF THE PREFERRED EMBODIMENT

Figure 1A:
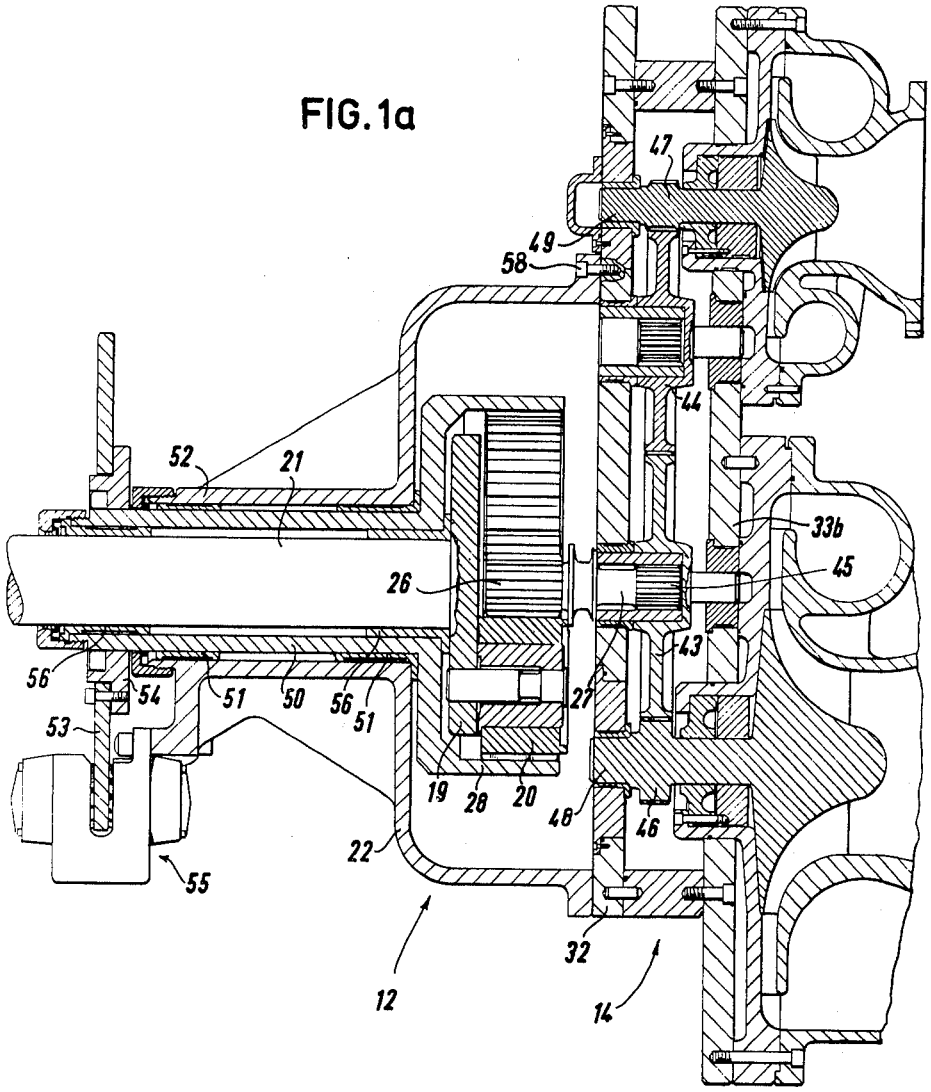
FIG. 1*a* is a plan view in section of a gear box of a compressor unit according to the invention.

Referring to the drawings, the two stage compressor unit is mounted on a base plate 10 (FIG. 2) and comprises a 4-pole 50 Hz electric motor 11 which rotates at 1,470 revolutions per minute. The motor drives an input to an epicyclic gear train 12 through a low speed coupling 13. The output of the epicyclic train 12 drives a series of parallel shaft speed increasing gears 14 as described in greater detail below with reference to FIG. 1*a*. The gears 14 increase the speed of the output shaft of the epicyclic train to the required speeds of the impeller shafts of the first and second stage compressors 15 and 16 respectively. A water-cooled intercooler 17 and an aftercooler 18 are also located on the base plate 10.

Figure 2:
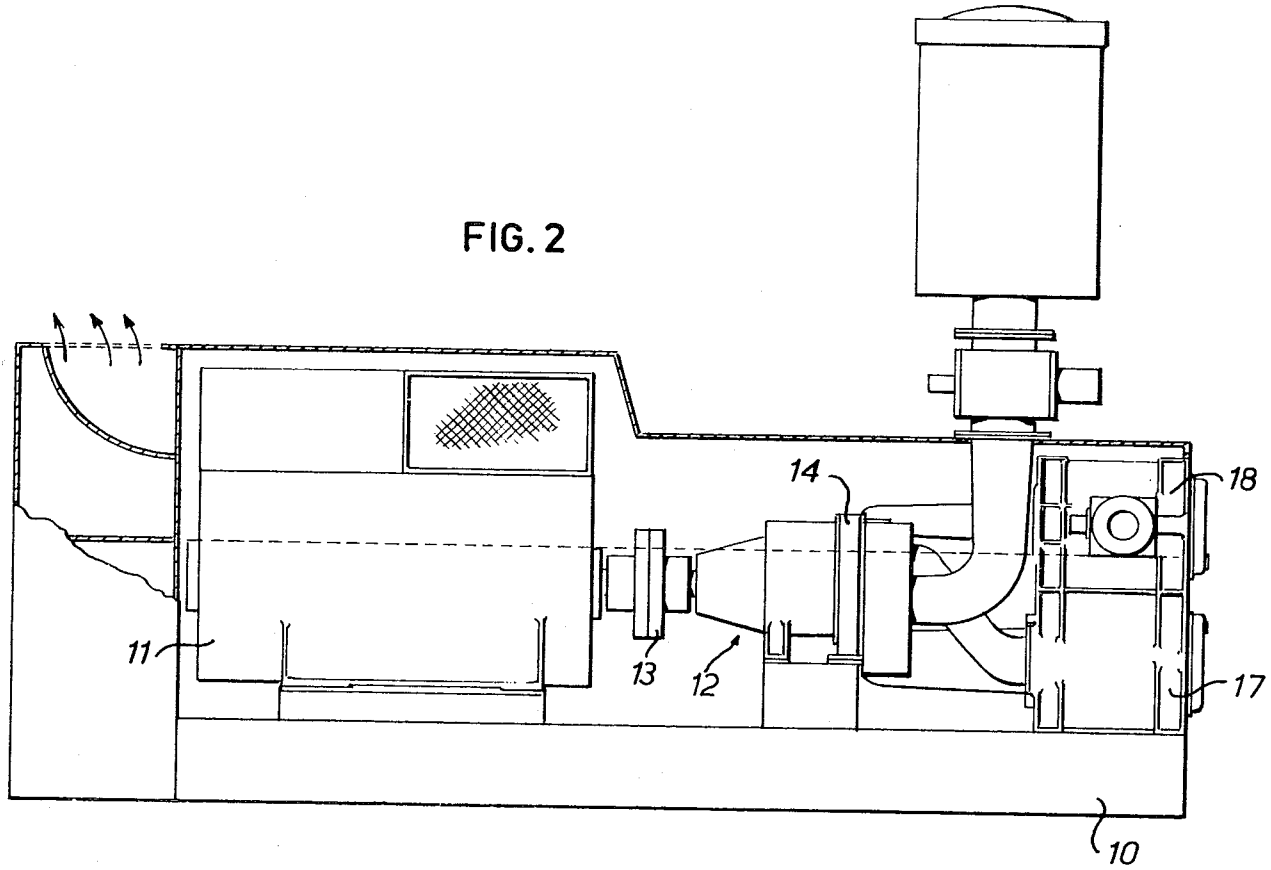
FIG. 2 is a side view of a two-stage compressor unit according to the invention.

Referring now specifically to FIG. 1*a* the epicyclic gear train indicated generally by the numeral 12 comprises a ring gear 28, a sun gear 26 and a planet carrier 19 on one face of which three planet gears 20, only one of which is shown in FIG. 1*a*, are rotatably mounted. The ring gear 28 has an integral tubular extension or projection 50 which provides a layshaft rotatably mounted in plain bearings 51 provided in a tubular portion 52 of the casing 22. A disc 53 is secured to a hub 54 fixedly located on the portion of the layshaft 50 projecting from the casing 22. One or more calipers 55 are provided on the casing 22 for braking the disc 53 to lock the ring gear 28 with respect to the casing 22.

The carrier 19 of the epicyclic gear train has an integral stub shaft 21 which is rotatably mounted within the hollow layshaft 50 in bearings 56 provided therein. The stub shaft 21 projects from the layshaft 50 so that it can be readily driven via a low speed coupling 13 by the motor unit 11. The sun gear 26 is provided at one end of an output shaft 27 which extends through the central aperture in an annular member. The output shaft 27 drives the speed increasing gear train 14 as described below.

The brake caliper 55 is actuated to brake the disc 53 by pressurised hydraulic medium supplied to a servo 59 by a hydraulic pump which also provides lubrication for at least some of the rotating parts of the assembly.

The caliper has resilient means to disengage it from the disc to release the braking force when the hydraulic fluid pressure is no longer supplied by the hydraulic pump, so that in the event of failure of the pump the impeller shafts will be reduced to relatively low idling speeds since the ring gear will be free to rotate.

Figure 4:
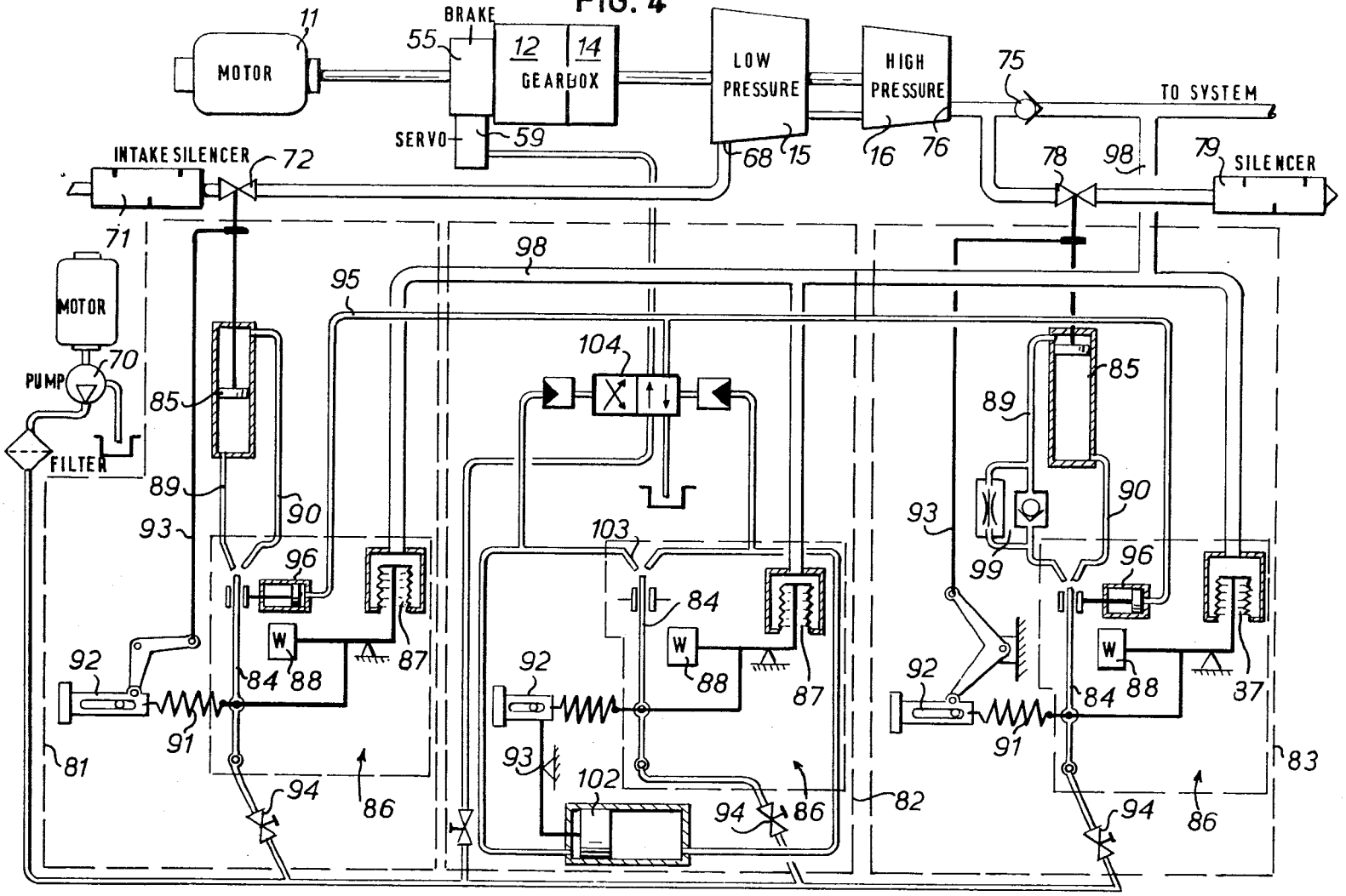
FIG. 4 is a diagram showing a control circuit for a two-stage compressor unit.

A circuit diagram showing the connections of the twostage compressor in use and the control circuit for actuating the brake caliper 55 is illustrated in FIG. 4.

The two stages of the compressor 15, 16 are driven by the motor 11 through the brake 55 and the gears trains 12, 14. A pump 70 is also driven from the motor and gear box system as described above.

Air is supplied to the inlet 68 to the low pressure stage 15 of the compressor through a silencer 71 and a suction throttle valve 72. The compressed air produced by the compressor is supplied to the user system through a non-return valve 75 connected in series with the outlet 76 of the high-pressure stage 16 of the compressor. A blow off valve 78 and silencer 79 are also connected to the outlet 76. The air pressure on the system side of the non-return valve 75 is also used to control actuator relays, indicated generally by 81, 82, 83 for the suction throttle valve 72, the brake servo 59 and the blow off valve 78 respectively.

Actuator relay 81 is essentially a pressure operated device which proportionally controls the suction throttle valve between predetermined set values of pressure. A double acting hydraulic cylinder 85 is arranged to drive the valve in accordance with signals from a jet pipe controller 86. The signal from the jet pipe controller 86 actuates the cylinder 85 through a bellows impulse system 87 including a weight 88 to counter part of the signal pressure and connected to the cylinder by connections 89, 90. Opposing the control signal is a spring 91 with a feedback connection 93 from the cylinder and a preset 92 which is adjustable to set the predetermined pressure at which the actuator system will operate. A oil-supply stop valve 94 is fitted to the inlet union for isolating the actuator system 81. In order to provide a means of holding the suction throttle valve fully open under certain conditions, a small hydraulic cylinder 96 is arranged to deflect the jet pipe 84 when an oil pressure signal is applied by the brake actuator relay 82 via connection 95. The air signal to the jet pipe controller is applied through connection 98.

The actuator relay 83 for the blow off valve 78 comprises the same basic elements as relay 81 and like parts are indicated by like reference numerals. In order to provide a means of controlling the speed of closing of the blow off valve, relay 83 further includes a non-return throttle valve 99 in the connection 89.

The actuator relay 82 for the brake servo 59 is essentially a "flip-flop" device arranged to provide a hydraulic signal to the servo and to block the supply to disengage the brake. Relay 82 includes a further jet pipe controller 86 actuated by an air signal applied through connection 98. The impulse system again comprises a bellows type system 87 with a counter-weight 88 and opposed by a spring 91 coupled by a feedback connection 93 to a double acting cylinder 102, which senses the output of the distributor 103. A double-acting pilot operated changeover valve 104 is operated by the distributor to control the oil supply to the servo and is also connected to the jet pipe deflector cylinders 96 by connections 95.

The operation of this control circuit is as follows.

The basic requirement of this control system is to monitor the air system pressure downstream of the non-return valve fitted to the packaged unit and to operate in sequence the suction throttle valve, blow off valve and brake servo when the system pressure has reached values which require control action.

In the example described, the pressure figures at which the system operates are as follows:

With an air system pressure of 100 p.s.i. the suction throttle valve is required to start closing at a rate approximately proportional to 25% of travel for each 1 p.s.i. rise of system pressure.

The blow off valve must be arranged to start opening at a system pressure of 102 p.s.i. and proceed to open at the rate of 50% for each 1 p.s.i. rise of pressure.

The disc clutch servo relay must disengage the clutch when a system pressure of 104 is reached and reengage the clutch when the pressure has fallen to 102 p.s.i.

The control system operates in the following manner:

1. At pressures up to 100 p.s.i.g. beyond the nonreturn valve, the suction throttle valve will be fully open, the blow off valve will be fully shut, and the brake will be engaged.
2. With the system pressure at 100 p.s.i. and rising towards 102 p.s.i., the suction throttle valve will commence to close proportionally, the blow off valve will remain shut, and the brake will remain engaged.
3. With the system pressure at 102 p.s.i. and rising towards 104 p.s.i., the suction throttle valve will be passed the half open position and will continue closing, the blow off valve will commence to open proportionally, and the brake will remain engaged.
4. When the system pressure reaches 104 p.s.i., simultaneously, the suction throttle valve will have moved to the fully closed position and will be held in that position by the jet pipe deflector cylinder, the blow off valve will have moved to the fully open position and will be held there by the jet pipe deflector cylinder, and the brake will be disengaged by the servo relay.
5. The air system will now be isolated from the compressor by the non-return valve which may have commenced closing before Item 4 was reached. If the demand for air rises, the system pressure will fall.
6. If the demand for air causes the system pressure to fall towards 102 p.s.i., the following action will take place:

At a pressure of 102 p.s.i., the disc clutch servo relay will reverse its action and supply the 200 p.s.i. hydraulic signal to the brake which will then re-engage, simultaneously the suction throttle valve and blow off valve controller push knob cylinders will be de-energised and each controller will be allowed to operate its valve so that the blow off valve will slowly commence to close and the suction throttle valve will move to the half open position. If the system pressure continues to fall, the suction throttle valve will go fully open when the system pressure has reached 100 p.s.i.

At any stage during the above events if the air system pressure stabilizes at any point between 100 and 102 p.s.i. the suction throttle valve will proportionally control the air flow to the system in accordance with demand.

Should the pressure stabilize between 102 and 104 p.s.i. rising, the suction throttle valve will behave in the same way and the blow off valve controller will proportionally position the blow off valve in accordance with the signal pressure. If the pressure stabilizes between 104 and 102 p.s.i. falling, the compressor will remain idling or shut down until the pressure has fallen to 102 p.s.i.

Figure 1B:
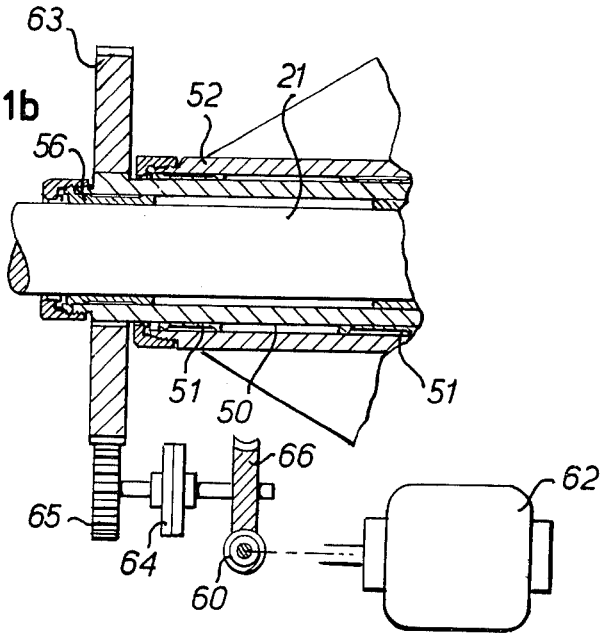
FIG. 1*b* is a scrap plan view in section of the gear box of FIG. 1*a*) showing a modification.
Figure 3:
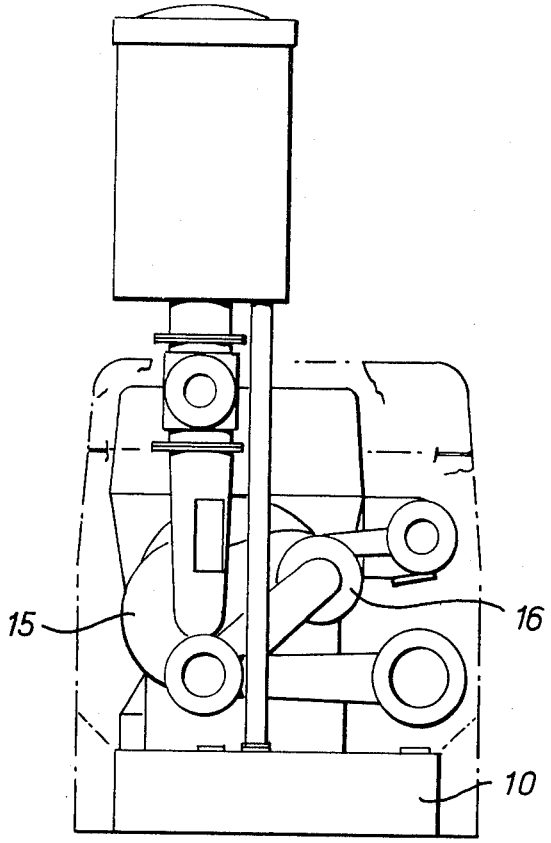
FIG. 3 is an end view of the compressor unit shown in FIG. 2 without the intercooler and aftercooler.

Instead of braking the disc 53 using a caliper, a worm drive from an additional motor 62 may be provided to drive a gear 63 which replaces the disc 53 (FIG. 1*b*). In this case, the gear 62 will be in mesh with another gear 65 which is connected to a worm gear 66 through a clutch 64. A worm 60 driven by a motor 62 is in mesh with the gear 66. It will be appreciated that the worm 60 which engages with teeth formed on the periphery of the gear 66 provides a self-locking connection whereby the gear 63 is held stationary when the worm is not rotating and the clutch is engaged. A thrust bearing is provided on the additional motor 62 to prevent the gear 63 rotating in this situation. Furthermore, it is also possible instead of holding the gear 63 stationary in this way to rotate the worm at a controlled speed if it is required to alter the overall gear ratio of the epicyclic train, for example to effect a fine tuning of the system for individual installations. With such arrangements employing a worm drive to the gear 63, it is necessary to be able to declutch the worm drive, and the clutch 64 is provided for this purpose. When the worm wheel is declutched, the gear 63 becomes freely rotatable thereby effecting unloading of the impeller shafts in a similar manner to releasing the brake caliper 55 as described below.

The speed increasing gear train comprises two intermeshing input gears 43 and 44 rotatably mounted in mesh with one another between end walls 32 and 33*b* of the casing for that gear train. The gears 43 and 44 are internally splined so that the splined end portion 45 of the output shaft 27 of the epicyclic gear train can be drivably connected with either one of the gears 43 and 44 as required. FIG. 1 shows the splined end portion 45 connected to gear 43. In order to connect it to gear 44, the epicyclic gear train 12, and its casing 22 are unbolted from the position shown in FIG. 1 by removing bolts 58 (only one of which is shown in FIG. 1) and rebolted to the end wall 32 so that the splined end portion 45 is connected to gear 44. Further gears 46 and 47 are provided on shafts 48 and 49 respectively which are parallel to one another and project from the end wall 33*b* for driving respectively the impellers of the two stages of the compressor, and are in mesh with the input gears 43 and 44 respectively. The gears 46 and 47 and their respective shafts 48 and 49 are formed integrally.

The ratio of the teeth on gear 43 and gear 44 is 6:5 so that it is possible to use a 50 Hz or a 60 Hz motor as required to drive the gear train since the shafts carrying the gears 43 and 44 will rotate at the same speeds respectively to rotate gears 46 and 47 at their correct operating speeds when a 50 Hz 4-pole motor is used to drive the epicyclic gear train and when shaft 27 drives gear 43, or when a 60 Hz 4-pole motor is used to drive the epicyclic gear train and when the shaft 27 drives gear 44, so that it is merely necessary to select the correct gear 43 or 44 to be driven by the shaft 27 according to whether a 50 Hz or a 60 Hz motor is used.

Although a two-stage compressor is described above it will be appreciated that the arrangement described can be used for centrifugal compressors having any number of stages.

An advantage of the above described arrangement is that in machines below the 1500 H.P. category it allows higher running speeds from a given input speed than is possible with a single train parallel shaft arrangement with which it is difficult to provide optimum compressor speeds for stage pressure ratios above 2:1.

Thus the selected gearing makes possible a two stage compressor arrangement with both stages operating at the optimum speeds for a pressure ratio of approximately 3.0:1 for each stage. The much higher gear ratio available with the two train system allows the use of quieter and more acceptable 4-pole motor.

Furthermore the nature of the epicyclic first train allows the drive to be readily uncoupled for control purposes.

With the proposed gear arrangement it is possible to release the annulus system of the primary epicyclic gear train as described above, to unload the impeller shafts so that the high speed impeller shafts then rotate at a relatively low idling speed and hence uses a very low unloaded horsepower. Thus simple plain bearings may be used as they will always be loaded when running at full speed and so avoid the stability problems associated with light load high-speed running. Moreover, the impeller shafts can be offloaded without the need to stop and restart the main drive motor which is desirable particularly with large electric motors which cannot be restarted frequently.

Many modifications of the above described integrally geared centrifugal compressor unit are possible within the scope of the invention. For example, the braking system described above can be replaced by other forms of braking systems which provide a releasable connection between the ring gear 28 and a fixed part of the gearbox, for example hydraulically operated clutch plates within the casing 22 for frictionally engaging corresponding plates fixed with respect to the ring gear 28. It would also be possible to use a band brake which extends around and, when operated, acts on the external surface of the ring gear to brake the gear. In another possible braking system, a peripheral disc may extend radially outwards from the external surface of the ring gear. The brake then comprises either a multi-plate clutch which, when operated, frictionally engages the disc, or disc brake calipers at spaced locations around the peripheral disc which acts on the disc when operated to effect braking. In such a braking system, the friction elements are readily accessible without dismantling the gear train for replacement purposes. In yet another possible braking system, the ring gear may have an annular series of gear teeth on its external surface. A layshaft may be geared to the teeth on the ring gear and may extend outside the gearbox. A disc brake, an electro-magnetic brake on any other suitable form of brake may be mounted on the layshaft outside the gearbox so that the brake is accessible without any dismantling of the gearbox.

I claim:

1. A centrifugal compressor comprising at least one stage with its own impeller shaft, a bearing for said shaft;

an inlet for gas to be compressed;

an outlet for compressed gas;

an epicyclic gear train for driving the impeller shaft which epicyclic gear train comprises three members, a sun gear, a ring gear and a carrier on which a series of planet gears are mounted in mesh with the sun and ring gears, means to connect power input means to one of the members of the epicyclic gear train and means connecting a second of the members to the impeller shaft, said last means comprising a step-up gear train composed of at least two parallel shaft gears;

means for braking the rotational speed of the third of said members to control the speed of the impeller shaft; and, actuating means for automatically releasing the braking means to unload the impeller shaft when the pressure of the compressed gas falls whereby to prevent the impeller shaft from running in the bearing in an unloaded high speed condition.

2. A compressor as claimed in claim 1 wherein there is provided a layshaft which rotates with said third of the members and extends outside a casing containing the epicyclic gear train, said means for braking the rotational speed of said third member being located outside the casing and operable to control the speed of the layshaft and thereby the speed of the impeller shaft.

3. A compressor as claimed in claim 2 wherein said braking means comprises a disc fixed to rotate with the layshaft and a friction brake means operating on the disc to brake the layshaft.

4. A compressor as claimed in claim 3 wherein said friction brake means are operable by a servo supplied with hydraulic pressure by the actuating means, said brake means being automatically released to unload the impeller shaft when the hydraulic pressure is removed.

5. A compressor as claimed in claim 4 further comprising a suction throttle valve connected to the said inlet and wherein the actuating means comprises a first relay connected to the servo to engage and disengage the brake servo and a second relay operable to proportionally control the suction throttle valve.

6. A compressor as claimed in claim 5 further comprising a blow off valve connected to said outlet and wherein the actuating means further comprises a third relay for proportionally controlling the blow off valve.

7. A compressor as claimed in claim 6 wherein means are provided interconnecting said first, second and third relays to sequentially operate the said suction throttle valve and blow off valve.

8. A compressor as claimed in claim 1 wherein said input is associated with the planet carrier and the output is associated with the sun gear.

9. A compressor as claimed in claim 2 wherein said input comprises an input drive shaft connected to the planet carrier, and the layshaft is an elongate tubular projection associated with the ring gear and surrounding a portion of said input drive shaft.

* * * * *